US006592683B2

(12) United States Patent
Hirose et al.

(10) Patent No.: US 6,592,683 B2
(45) Date of Patent: Jul. 15, 2003

(54) TI ALLOY SURFACE TREATMENT

(75) Inventors: Masahito Hirose, Fujisawa (JP); Hiroaki Asanuma, Fujisawa (JP)

(73) Assignee: Fuji Oozx Inc., Fujisawa (JP)

( * ) Notice: Subject to any disclaimer, the term of this patent is extended or adjusted under 35 U.S.C. 154(b) by 0 days.

(21) Appl. No.: 09/990,982

(22) Filed: Nov. 21, 2001

(65) Prior Publication Data

US 2003/0047243 A1 Mar. 13, 2003

(30) Foreign Application Priority Data

Sep. 3, 2001 (JP) ..... 2001-265461

(51) Int. Cl.[7] ..... C23C 28/00

(52) U.S. Cl. ..... 148/276; 148/278; 148/280; 148/281; 148/206; 427/189

(58) Field of Search ..... 148/240, 276, 148/278, 280, 281, 206; 427/189

(56) References Cited

U.S. PATENT DOCUMENTS 4,936,927 A * 6/1990 Grunke et al. ..... 148/549
4,940,679 A * 7/1990 Claar et al. ..... 501/96.3

FOREIGN PATENT DOCUMENTS

FR 2769852 A1 * 4/1999 ..... B01J/2/00

* cited by examiner

*Primary Examiner*—John Sheehan
*Assistant Examiner*—Andrew L. Oltmans
(74) *Attorney, Agent, or Firm*—David A. Farah; Sheldon & Mak PC

(57) ABSTRACT

Ti alloy is embedded in a powder such as graphite and heated with the powder in an oxygen atmosphere. Oxygen atoms are diffused into the Ti alloy to form an oxygen diffusion layer of Ti—O solid solution, thereby increasing wear resistance of the valve. A poppet valve in an internal combustion engine may be made of such Ti alloy.

11 Claims, 6 Drawing Sheets

EXAMPLE 12

COMPARATIVE EXAMPLE 3

TI ALLOY SURFACE TREATMENT

CROSS-REFERENCE TO RELATED APPLICATION

The present Application claims the benefit of Japanese Patent Application No. 2001-265-461, filed Sep. 3, 2001, the contents of which are incorporated in this disclosure by reference in its entirety.

BACKGROUND OF THE INVENTION

The present invention relates to a method of treating the surface of Ti alloy.

Ti provides high specific strength but is likely to be worn. So surface treatment is required.

To make surface treatment to a Ti alloy poppet valve, there are thermal spray, Ni plating, nitriding in Japanese Patent Laid-Open Pub. No. 61-81505, oxidation in Japanese Patent Laid-Open Pub. Nos. 62-256956 and 3-36257, and plasma carburizing in Japanese Patent No. 2909361.

In thermal spray and plating, to remove an oxide film which is likely to be formed on the surface and to increase adhesion of hard material, the surface of a workpiece must be roughened by shot blasting and pretreated with acid washing to make the process more complicate to increase cost. Hard films are likely to come off.

In nitriding and oxidation, the workpiece is heated, which is relatively simple, but the surface is so hard as to increase offensiveness to an opposite member such as a valve seat and valve guide, which must be replaced in material to increase cost.

In oxidation, a workpiece is heated in oxygen excessive atmosphere to increase oxygen diffusion speed and to form a relatively thick fragile oxide film such as $TiO_2$ and $Ti_2O_3$, which is likely come off. So the oxide film must be removed by shot blasting or machining until an oxygen diffusion layer appears, thereby increasing cost.

In plasma carburizing, wear resistance required for a poppet valve is available, but it is necessary to provide expensive equipment such as vacuum furnace and plasma electric source to increase depreciation and running cost which causes increased unit price.

SUMMARY OF THE INVENTION

It is an object of the present invention to provide a method of treating the surface of Ti alloy to increase wear resistance at low cost and simple means.

In order to achieve the object, according to the present invention, there is provided a method of treating the surface of Ti alloy, comprising the steps of embedding the Ti alloy in oxygen-absorptive powder, and heating said Ti alloy with the powder in oxygen atmosphere to diffuse oxygen atoms into the Ti alloy to form an oxygen diffusion layer of Ti—O solid solution.

Without forming an oxide layer on the surface of Ti alloy, a hard oxygen diffusion layer can be formed to provide a wear-resistant Ti alloy.

BRIEF DESCRIPTION OF THE DRAWINGS

The features and advantages of the present invention will become more apparent from the following description with respect to embodiments as shown in appended drawings wherein.

DETAILED DESCRIPTION OF PREFERRED EMBODIMENTS

FIGS. 1 to 4 illustrate each step of a process for treating the surface of Ti alloy according to the present invention. Ti alloys to which surface treatment is applied include α-β Ti alloy such as Ti—6Al—4V, and near α-alloy such as Ti—6Al—2Sn—4Zr—2Mo. Surface treatment is applied to a poppet valve made of such alloys.

Materials to be applied by the present invention may include Ti—5Al—2.5Sn, Ti—6Al—6V—2Sn, Ti—6Al—2Sn—4Zr—6Mo, Ti—8Al—Mo—V, Ti—13V—11Cr—3Al and Ti—15Mo—5Zr—3Al as well as pure Ti and Ti—Al intermetallic compound.

Figure 1:
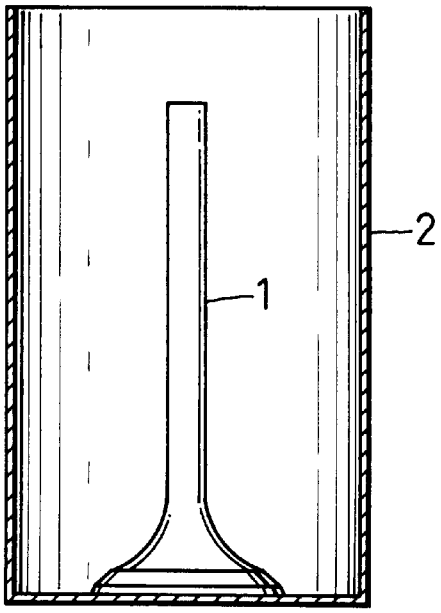
FIG. 1 is a vertical sectional front view which illustrates a poppet valve in a vessel before treatment according to the present invention.
Figure 2:
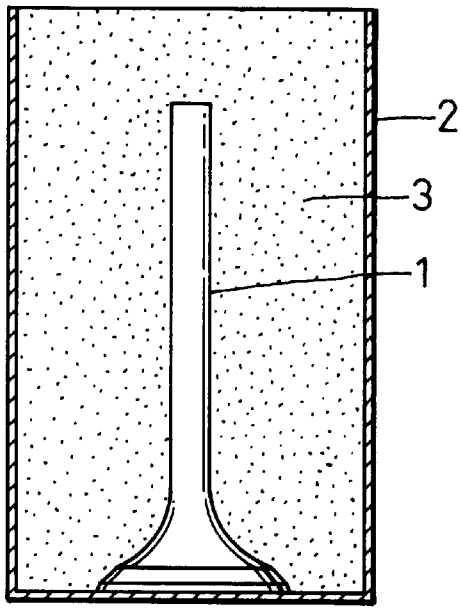
FIG. 2 is a vertical sectional front view which illustrates that the vessel is filled with graphite powder in which the poppet valve is placed.
Figure 3:
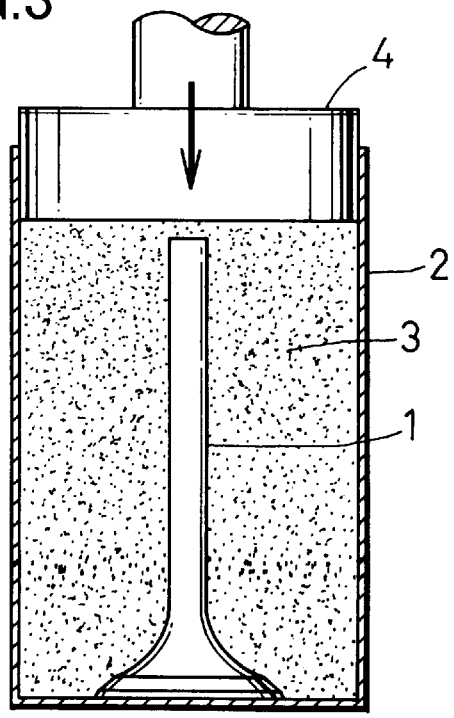
FIG. 3 is a vertical sectional front view which illustrates that the graphite powder is compressed to increase density.

A poppet valve 1 is put in a cylindrical stainless heat resistant vessel 2 as shown in FIG. 1, and the vessel 2 is filled with graphite powder 3 in which the poppet valve 1 is placed. Then, as shown in FIG. 3, if required, the graphite powder 3 are compressed by a press to increase density.

Owing to filtering and oxygen-absorption of the graphite powder 3, oxygen or air atmosphere is formed around the poppet valve. The lower porosity of the graphite powder 3 is, the higher filtering is, thereby decreasing permeability of oxygen and increasing oxygen which is absorbed into the graphite powder 3.

When the poppet valve is made of Ti—6Al—4V, the porosity of the graphite powder 3 may preferably range 30 to 55%, and when it is made of Ti—6Al—2Sn—4Zr—2Mo, the porosity may preferably range 55 to 75%.

Ti—6Al—4V provides property that it is likely to be oxidized. Thus, if porosity of the graphite powder 3 is above 55%, filtering and absorption of oxygen decreases to make oxygen excessive atmosphere to form oxide film on the surface of the poppet valve 1. If porosity is below 30%, filtering of oxygen and oxygen absorption by graphite powder 3 increase to become less oxygen atmosphere, thereby increasing time required for oxygen diffusion. Therefore, porosity of the graphite powder 3 for Ti—6Al—4V alloy may preferably range 30 to 55%.

Ti—6Al—2Sn—4Zr—2Mo has higher heat resistance and less oxidation property than Ti—6Al—4V. Porosity of the graphite powder 3 is increased to about 75%, which is the lowest density available, to increase permeability of oxygen so as to create oxygen excessive atmosphere around the poppet valve 1.

If porosity of the graphite 3 is reduced to below 55%, time required oxygen diffusion is extremely increased owing to oxygen shortage, thereby failing in satisfying mass production. Therefore, porosity of the graphite powder 3 may preferably range 55 to 75% when Ti—6Al—2Sn—4Zr—2Mo is employed.

Particle diameter of the graphite powder 3 affects surface roughness of the poppet valve after surface treatment, and may preferably be below 75 $\mu$m or 200 mesh. After treatment, surface roughness of about 0.8 $\mu$m(Ra) is achieved to facilitate finishing.

Figure 4:
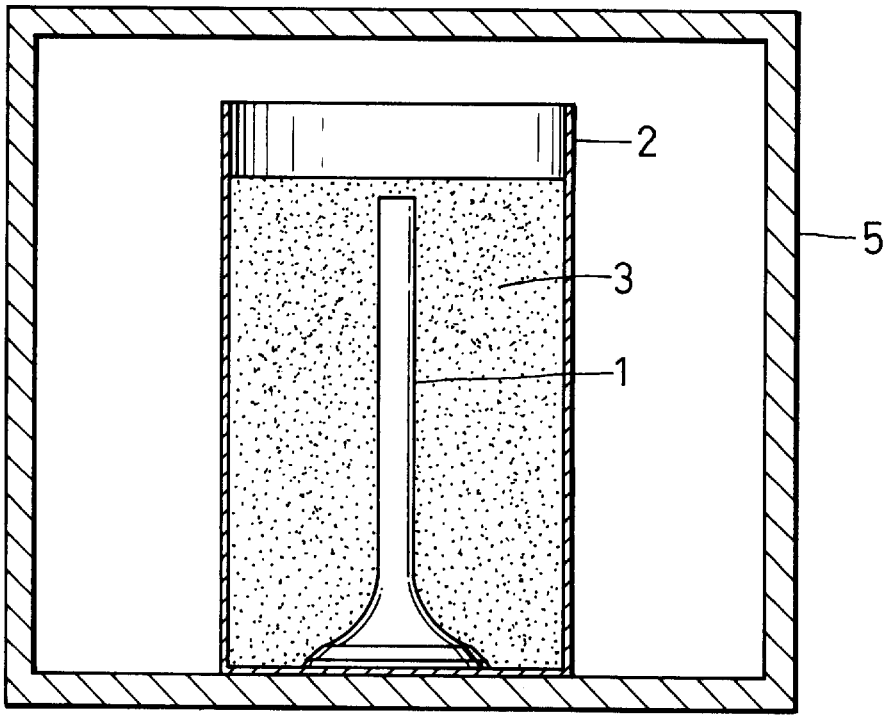
FIG. 4 is a vertical sectional front view which illustrates that the vessel is put in an atmospheric furnace with the poppet valve for heating.

The poppet valve 1 is covered with the graphite powder 3, and as shown in FIG. 4, the vessel 2 itself is put in an atmospheric furnace 5 or low vacuum furnace and heated at 700~900° C., preferably 800~850° C., below β transformation point of the Ti alloys, for 0,5 to 3 hours.

Heating temperature below transformation point of Ti alloys is due to prevent Ti alloy structure from modifying such as ascillation and enlargement which leads decrease in toughness and increase in deformation.

Below 700° C., oxygen diffusion layer is thin, and above 900° C., deformation or bending occurs to cause an oxide layer.

At last, the poppet valve 1 to which surface treatment is applied is cooled to room temperature with a gas such as a nitrogen gas without air.

Referring to Tables 1 and 2, examples will be described.

TABLE 1

| | Temperature (° C.) | Time (h) | Surface Hardness (Hv) | Oxide Layer |
|---|---|---|---|---|
| Example 1 | 750 | 3 | 570 | none |
| Example 2 | 800 | 0.5 | 640 | none |
| Example 3 | 800 | 1 | 730 | none |
| Example 4 | 800 | 1.5 | 795 | none |
| Example 5 | 800 | 2 | 730 | none |
| Example 6 | 800 | 3 | 860 | none |
| Example 7 | 850 | 1 | 910 | none |
| Comparative Example 1 | 900 | 1 | 955 | formed |
| Comparative Example 2 | 1000 | 0.5 | 970 | formed |

Table 1 shows the following examples and comparative examples of a poppet valve made of Ti—6Al—4V by hot forging with surface treatment. Porosity of a graphite powder was 55%.

EXAMPLE 1

A poppet valve was kept for three hours at 750° C., and cooled with a nitrogen gas below 500° C. to room temperature. On the valve surface, an oxide layer was not formed. Owing to such low temperature, a thin oxygen diffusion layer was merely formed, and hardness was slightly risen.

EXAMPLES 2 to 6

In Examples 2 to 6, the temperature was fixed at 800° C., and only time was changed from 0.5 to 3 hours. The longer time was, the higher surface hardness was. In those except Example 2, hardness over Hv 700 required for poppet valves was obtained.

The surface layers were analyzed with a microscopic analyzing device, and oxygen diffusion layers of Ti—O solid solution were identified on the surface of the poppet valves without Ti oxide layer. Preferable results were obtained.

However, in Example 2, time was too short, and oxygen diffusion layer was relatively thin. Hardness was low and was not suitable for poppet valves used in an internal combustion engine.

EXAMPLE 7

A poppet valve was heated for one hour at 850° C. to increase surface hardness to Hv 910. There was no oxide layer on the valve surface, and an oxygen diffusion layer was identified.

Comparative Example 1

A poppet valve was heated at 900° C. for one hour. A surface hardness was Hv 955, but the temperature was too high. An oxide layer was formed on the surface of the valve and deformation was large. It was not suitable.

Comparative Example 2

Treatment temperature was raised to 1000° C., and a poppet valve was heated for 0.5 hours. Similar to Comparative Example 1, high surface hardness was obtained. But, owing to high temperature, a thick oxide layer was formed and deformation was large, so that it was not suitable for actual use.

In Examples 1 to 7, the surface layer was analyzed by a microscopic X-ray analyzing device and Auges spectroscopy. In addition to the oxygen diffusion layer, a carbon diffusion layer of Ti—C solid solution was identified. This is because CO and $CO_2$ were generated with oxidation by the graphite powder heated at high temperature, C therein being diffused into the valve to form the carbon diffusion layer.

When Ti alloys were treated by solid or gas carburizing, a hard oxide layer of $TiO_2$ was formed by oxidation of carburizing agents with active Ti, so that carburizing was suppressed. In the examples according to the present invention, thin oxygen atmosphere was formed by the graphite powder not to form oxide layer on the surface, thereby facilitating diffusion of carbon atoms. A hardened layer which contains oxygen and carbon diffusion layers was formed on the surface to improve wear and burning resistance and to relieve offensiveness.

Figure 5:
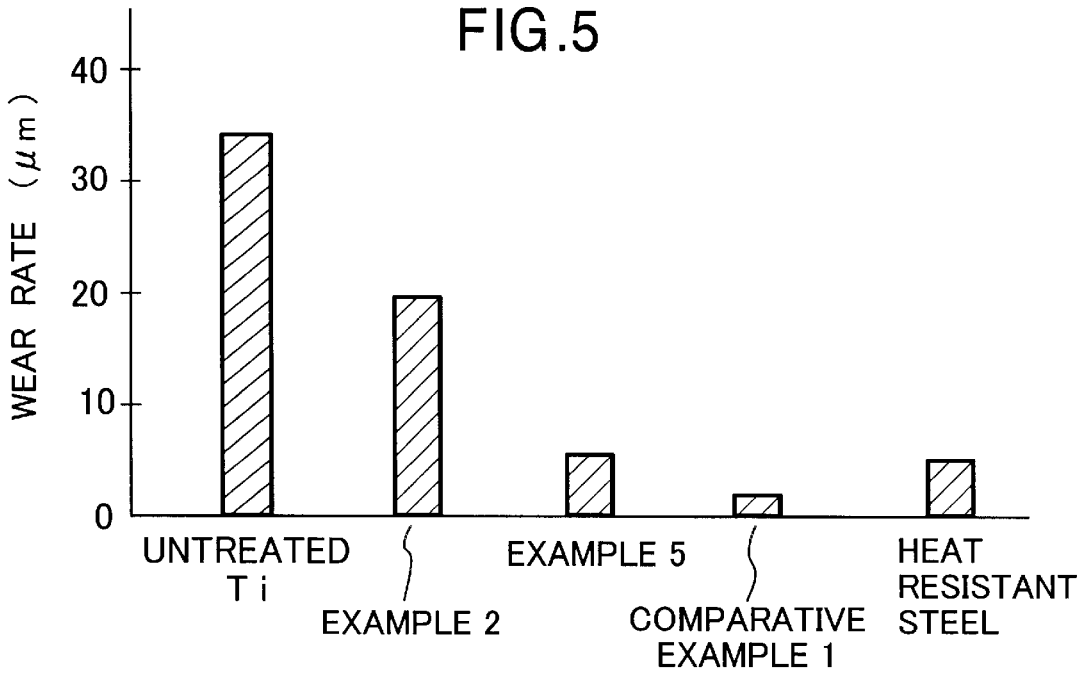
FIG. 5 is a graph which illustrates the results of anti-wear test to Ti—6Al—4V and comparative examples.

Examples 3 to 7 are particularly suitable when it is applied to poppet valves placed in severe condition such as in an internal combustion engine of an automobile, but the conditions of Examples 1and 2 may be accepted when they are employed in other materials which require only wear resistance at low temperature, FIG. 5 illustrate results of anti-wear tests of test pieces made of Examples 5, 2, and 1, untreated Ti—6Al—4V, and tufftriding-applied heat resistant steel, the test pieces corresponding to valve stems for poppet valves.

Figure 6:
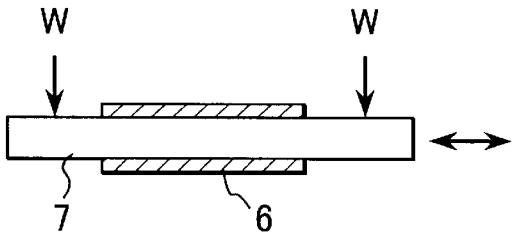
FIG. 6 is a view which illustrates how to make anti-wear test.

As a method of testing, as shown in FIG. 6, the test piece 7 was inserted in a valve guide 6 made of sintered iron, and lubricating oil was supplied between the piece and guide. Vertical load "W" such as 6 kgf was applied and the piece was reciprocally slid for 50 hours.

Wear was the largest of the test piece 7 formed by untreated Ti—6Al—4V, and gradually became smaller in order of Example 2, Example 5, heat-resistant steel and Comparative Example 1. Example 5 was equivalent in wear to tuftriding-applied heat-resistant steel. It was considered as difference in surface hardness that Example 2 is larger in wear than Example 5. The lowest wear rate in Comparative Example 1 is considered due to a hard oxide layer formed on the surface. The valve was too rigid in Comparative Example 1, so that the valve guide 6 in which it was engaged was also the largest in wear.

Table 2 shows examples and comparative examples of poppet valves which were made of Ti—6Al—2Sn—4Zr—2Mo by hot forging, surface treatment being applied thereto. Porosity of a graphite powder was 55%.

TABLE 2

| | Temperature (° C.) | Time (h) | Surface Hardness (Hv) | Oxide Layer |
|---|---|---|---|---|
| Example 8 | 750 | 3 | 550 | none |
| Example 9 | 800 | 0.5 | 610 | none |
| Example 10 | 800 | 1 | 700 | none |
| Example 11 | 800 | 1.5 | 760 | none |
| Example 12 | 800 | 2 | 810 | none |
| Example 13 | 800 | 3 | 850 | none |
| Example 14 | 850 | 1 | 900 | none |
| Comparative Example 3 | 900 | 1 | 950 | formed |
| Comparative Example 4 | 1000 | 0.5 | 950 | formed |

With respect to temperature and time, the embodiments are the same as Examples 1 to 7, and Comparative Examples 1 and 2.

In the examples 10 to 14, hardness is slightly lower than those of Ti—6Al—4V. Surface hardness of Hv 700 to 850 required in a poppet valve was obtained. In Examples 8 to 14, an oxide layer was not formed on the surface, but it was identified that an oxygen diffusion layer of Ti—O solid solution and a carbon diffusion layer of Ti—C solid solution were formed.

Figure 7:
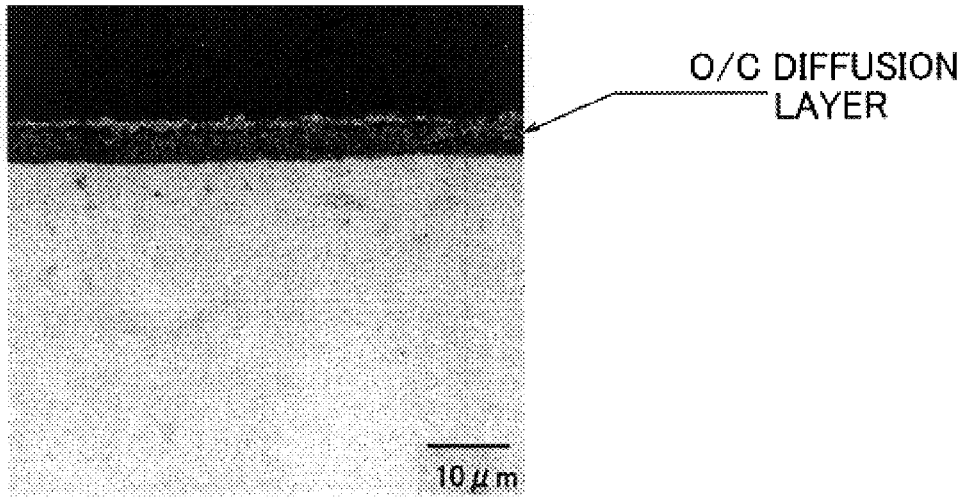
FIG. 7 is a micrograph of the surface layer of Example 12.

FIG. 7 shows a micrograph of the surface layer of a poppet valve treated by Example 12 which is optimum in the invention. In the micrograph, a hardened layer which comprises relatively thick oxygen and carbon diffusion layers is formed.

Figure 8:
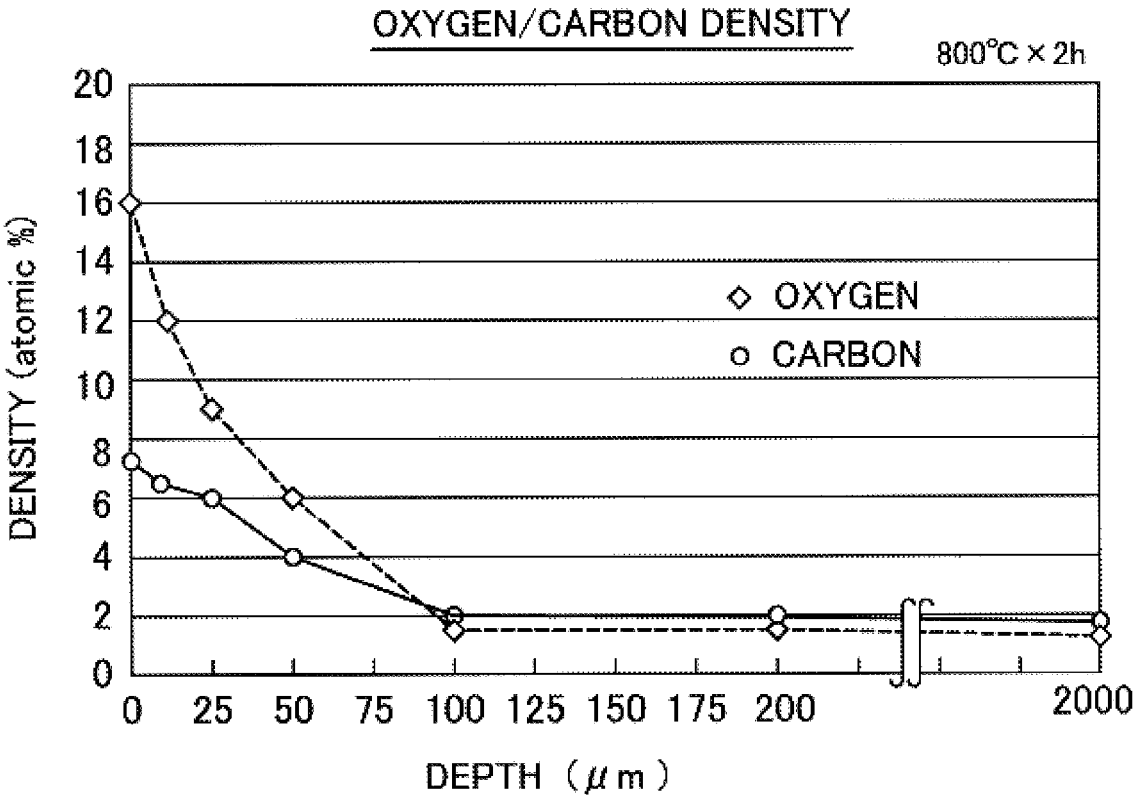
FIG. 8 is a graph which illustrates density distribution of Example 12.

FIG. 8 is a graph which shows average values of densities of oxygen and carbon of the surface layer of a poppet valve treated by Example 12 by an electric field Auger electronic spectroscopic device, an axis of abscissa being depth from the surface ($\mu$m), an axis of ordinate being density(atomic %) of oxygen and carbon. The atomic % stands for "rate of oxygen or carbon atoms in analyzed total atoms."

It will be easily understood that oxygen and carbon atoms are contained in the hardened layer formed on the surface of a poppet valve. Oxygen and carbon atoms are not combined with Ti, and are merely diffused.

Figure 9:
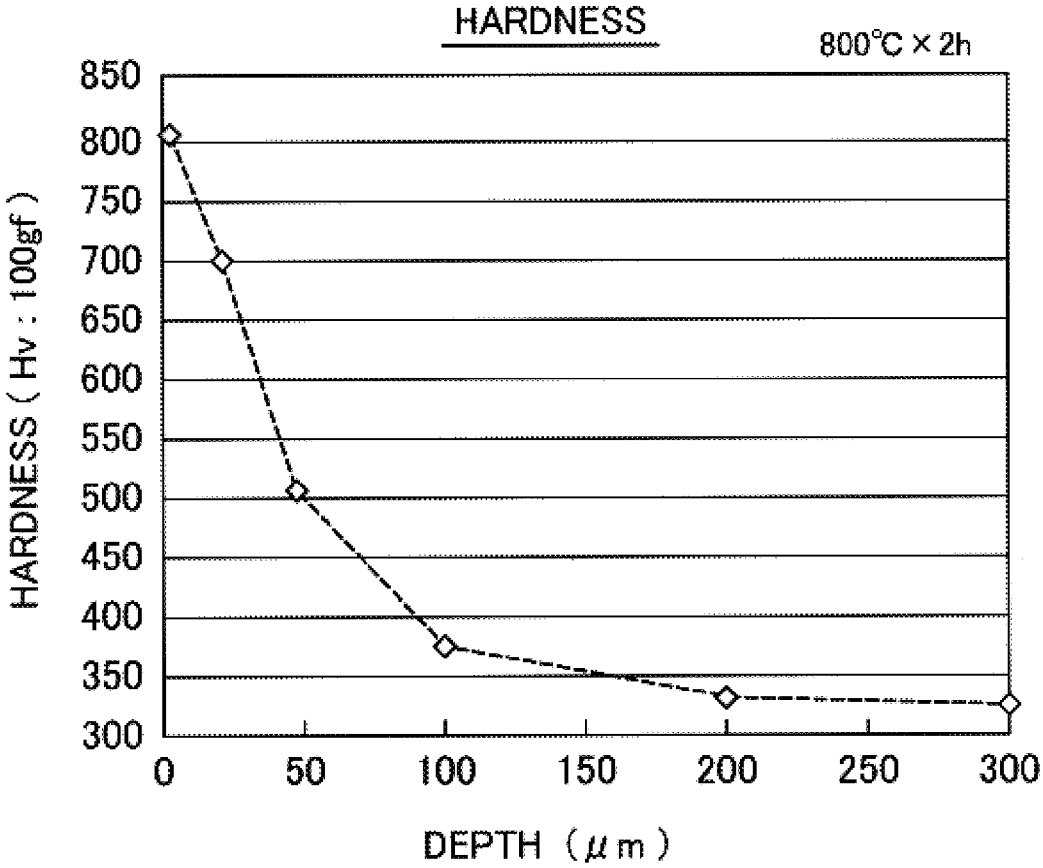
FIG. 9 is a graph which illustrates sectional hardness distribution of the surface layer of Example 12.

FIG. 9 shows hardnesses of poppet valves obtained by the Example 12 and measured with a Micro-Vickers durometer manufactured by Shimazu Mfg., Co. Ltd. In the graph, hardness relates to densities of oxygen and carbon in FIG. 8, and is high by the depth of 50 $\mu$m.

In Examples 8 and 9, an oxide layer is not formed on the surface, but owing to low treatment temperature and short time, a hardened layer comprising oxygen and carbon layer was thin, and hardness required in a poppet valve was not obtained.

Figure 10:
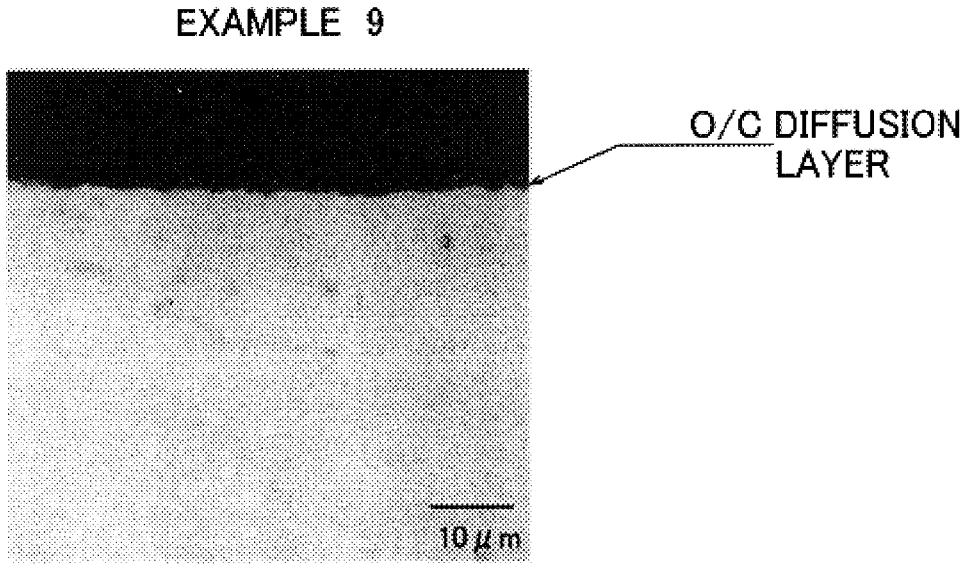
FIG. 10 is a micrograph of the surface layer of Example 9.

FIG. 10 is a micrograph of a surface layer of a poppet valve in Example 9 and shows that a thin hardened layer which comprises oxygen and carbon diffusion layers was formed.

In Comparative Examples 3 and 4, high surface hardness Hv 950 was attained. Similar to that of Ti—6Al—4V, owing to high temperature, an oxide layer is formed on the surface and deformation is too large.

Figure 11:
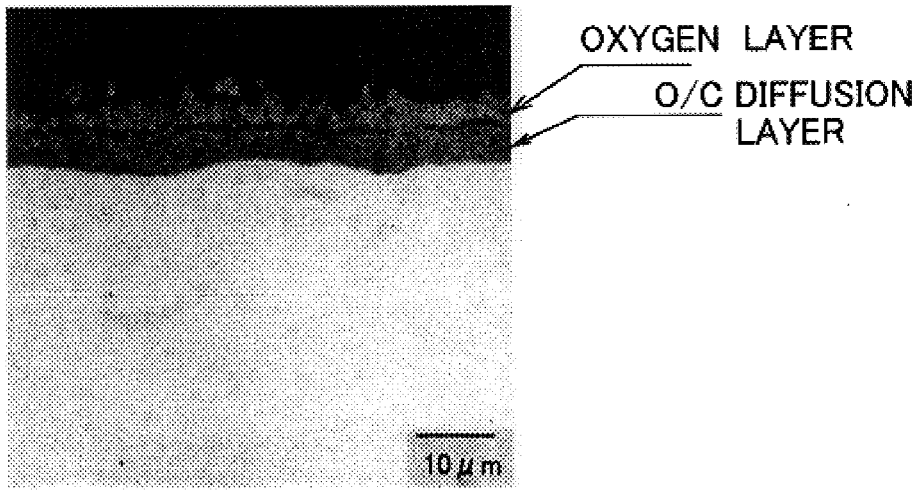
FIG. 11 is a micrograph of the surface layer of Comparative Example 3.

FIG. 11 shows a micrograph of a surface layer of a poppet valve in Comparative Example 3, and shows a thick oxide layer on oxygen and carbon diffusion layers.

Figure 12:
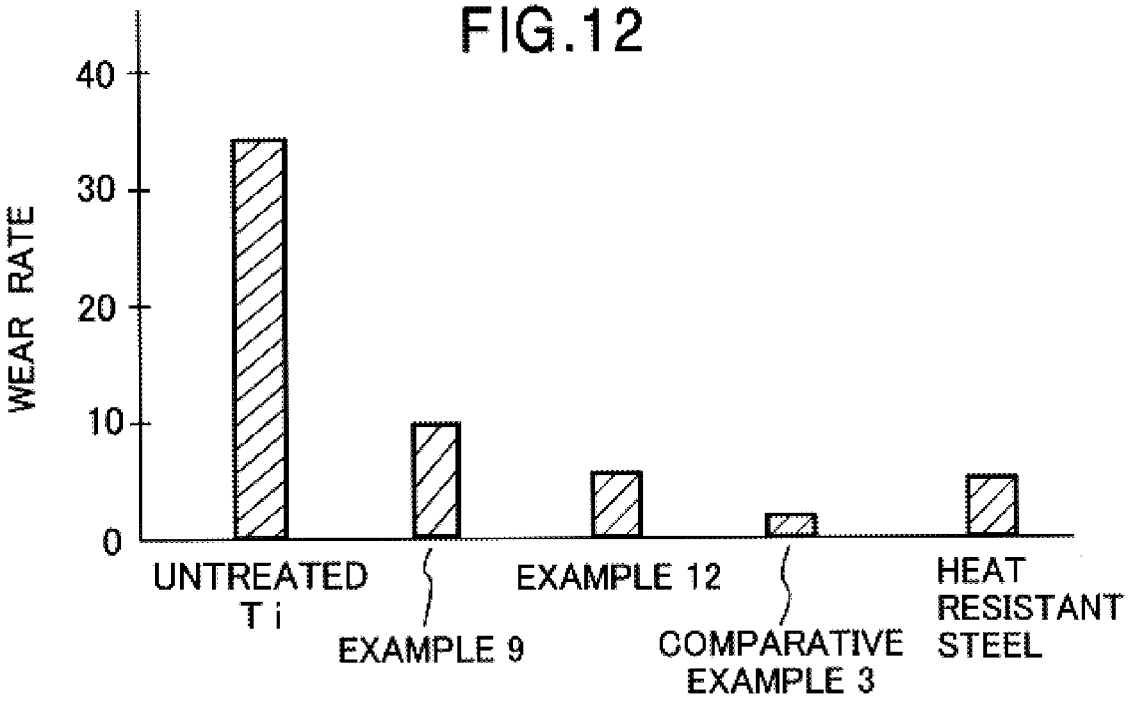
FIG. 12 is a graph which illustrates the results of anti-wear test to Ti—6Al—4V and comparative examples.

FIG. 12 shows the results of wear tests of test pieces made under the same conditions by Example 12, Example 9, Comparative Example 3, and untreated Ti—6Al—2Sn—4Zr—2Mo. Wear rate was similar to that in FIG. 5, and became lower in order of untreated Ti—6Al—2Sn—4Zr—2Mo, Example 9, Example 12 and heat-resistant steel and comparative example. Wear rate in Example 12 is substantially equal to that of heat-resistant steel and provides high wear resistance.

With respect to Comparative Example 3, wear rate became the lowest owing to rigid oxide layer, but wear rate of a valve guide increased.

As described above, the poppet valve 1 made of Ti alloy is embedded in the oxygen-absorbing graphite powder 3 and heated, so that without Ti oxide layer on the surface, the hardened layer in which oxygen and carbon diffusion layers coexist is formed to increase hardness of the valve surface, wear resistance, seizure resistance and offensiveness resistance, thereby omitting expensive treatment facilities such as plasma carburizing to decrease cost.

The graphite powder is employed as oxygen-absorbing powder, but Zr or its mixture with the graphite powder may be employed.

Owing to correlation between density and hardness of oxygen and carbon, porosity of graphite powder is changed depending on part of a poppet valve, thereby adjusting diffusion density of oxygen and carbon. For example, in a valve face or axial end required high hardness or wear resistance, by decreasing density of graphite powder, diffusion of oxygen is accelerated. Meanwhile, at an axial end which requires low hardness or high toughness, by increasing density, oxygen diffusion is restrained.

The present invention may be applied to a valve-operating parts, turbine parts, and surface treatment of articles which requires high wear resistance.

The foregoing merely relates embodiments of the invention. Various modifications and changes may be made by person skilled in the art without departing from claims wherein:

What is claimed is:

1. A method of treating a surface of Ti alloy, comprising the steps of:

a) embedding the Ti alloy in an oxygen-absorptive powder; and b) heating the Ti alloy with the powder in an oxygen atmosphere to diffuse oxygen atoms into the Ti alloy to form an oxygen diffusion layer of Ti—O solid solution;

where the oxygen-absorptive powder comprises a graphite powder.

2. A method of treating a surface of Ti alloy, comprising the steps of:

a) embedding the Ti alloy in an oxygen-absorptive powder; and b) heating the Ti alloy with the powder in an oxygen atmosphere to diffuse oxygen atoms into the Ti alloy to form an oxygen diffusion layer of Ti—O solid solution;

where porosity in the powder is kept high in Ti alloy which has low oxidizability, and kept low in Ti alloy which has high oxidizability.

3. A method of treating a surface of Ti alloy, comprising the steps of:

a) embedding the Ti alloy in an oxygen-absorptive powder; and b) heating the Ti alloy with the powder in an oxygen atmosphere to diffuse oxygen atoms into the Ti alloy to form an oxygen diffusion layer of Ti—O solid solution;

where particle diameter of the power is less than 75 $\mu$m.

4. The method of claim 1, where the Ti alloy comprises Ti—6Al—4V.

5. The method of claim 4, where porosity of the graphite powder is between 30 and 55%.

6. The method of claim 1, where the Ti alloy comprises Ti—6Al—2Sn—4Zr—2Mo.

7. The method of claim 6, where porosity of the graphite powder is between 55 and 75%.

8. A method of making a poppet valve for use in an internal combustion engine, where the poppet valve comprises Ti alloy, the method comprising:

a) providing the Ti alloy; and b) embedding the Ti alloy in an oxygen-absorptive powder;

c) heating the Ti alloy with the powder in an oxygen atmosphere to diffuse oxygen atoms into the Ti alloy to form an oxygen diffusion layer of Ti—O solid solution; and d) incorporating the Ti alloy into the poppet valve.

9. A method of making a poppet valve for use in an internal combustion engine, where the poppet valve comprises Ti alloy, the method comprising:

a) providing the Ti alloy; and b) processing the Ti alloy according to claim 1.

10. A method of making a poppet valve for use in an internal combustion engine, where the poppet valve comprises Ti alloy, the method comprising:

a) providing the Ti alloy; and b) processing the Ti alloy according to claim 2.

11. A method of making a poppet valve for use in an internal combustion engine, where the poppet valve comprises Ti alloy, the method comprising:

a) providing the Ti alloy; and b) processing the Ti alloy according to claim 3.

* * * * *